US007586250B2

(12) United States Patent
Iida et al.

(10) Patent No.: US 7,586,250 B2
(45) Date of Patent: Sep. 8, 2009

(54) LAMP HAVING AN ARC TUBE PROTECTED FROM BREAKAGE

(75) Inventors: Shiro Iida, Kyoto (JP); Kouhei Iwase, Takatsuki (JP); Yoshinori Kakuno, Katano (JP)

(73) Assignee: Panasonic Corporation, Osaka (JP)

( * ) Notice: Subject to any disclaimer, the term of this patent is extended or adjusted under 35 U.S.C. 154(b) by 438 days.

(21) Appl. No.: 11/172,030

(22) Filed: Jun. 30, 2005

(65) Prior Publication Data

US 2006/0006781 A1 Jan. 12, 2006

(30) Foreign Application Priority Data

Jul. 9, 2004 (JP) ..... 2004-203954
Feb. 10, 2005 (JP) ..... 2005-034894

(51) Int. Cl.
*H01J 5/48* (2006.01)
*H01J 5/50* (2006.01)
*H01J 5/00* (2006.01)

(52) U.S. Cl. ..... 313/318.02; 313/318.01; 313/493; 313/634

(58) Field of Classification Search ..... 313/318.01, 313/318.02, 318.05, 318.09, 493, 317
See application file for complete search history.

(56) References Cited

U.S. PATENT DOCUMENTS 2,337,744 A * 12/1943 Garstang ..... 362/216
2,406,146 A * 8/1946 Holmes ..... 313/610
2,501,376 A * 3/1950 Breadner et al. ..... 313/1
3,297,863 A * 1/1967 Robbiano ..... 362/549
4,549,252 A * 10/1985 Ripley et al. ..... 362/216
4,906,891 A * 3/1990 Takagi et al. ..... 313/318.02
5,034,655 A 7/1991 Murayama et al.
5,252,890 A * 10/1993 Yasuda ..... 313/493
5,465,025 A 11/1995 Hendrickson
5,675,215 A * 10/1997 Watson et al. ..... 313/493
5,751,104 A * 5/1998 Soules et al. ..... 313/493
7,021,985 B2 4/2006 Itaya et al.
7,053,540 B2 * 5/2006 Bobel ..... 313/318.1
7,064,488 B2 * 6/2006 Tomiyoshi et al. ..... 313/634
7,141,922 B2 * 11/2006 Yan ..... 313/491
7,196,462 B2 3/2007 Itaya et al.
7,205,712 B2 * 4/2007 Yan ..... 313/493
7,268,494 B2 * 9/2007 Yasuda et al. ..... 313/634
7,321,190 B2 * 1/2008 Nakanishi et al. ..... 313/318.02
7,423,370 B2 9/2008 Itaya et al.
2003/0234614 A1 12/2003 Itaya et al.
2005/0023947 A1 * 2/2005 Tsuneto et al. ..... 313/46
2005/0088076 A1 * 4/2005 Chu ..... 313/493
2005/0162089 A1 * 7/2005 Iida et al. ..... 313/634
2006/0170323 A1 * 8/2006 Hirsch et al. ..... 313/318.01
2007/0206380 A1 * 9/2007 Ham ..... 362/216

FOREIGN PATENT DOCUMENTS

| | | |
|---|---|---|
| CN | 2534674 Y | 2/2003 |
| DE | 871 927 | 3/1953 |
| JP | 2-61956 | 3/1990 |
| JP | 09-045283 | 2/1997 |
| JP | 10-233189 | 9/1998 |
| JP | 2003-17000 | 1/2003 |
| JP | 2004-103556 | 4/2004 |
| WO | WO 2004010460 A2 * | 1/2004 |

* cited by examiner

*Primary Examiner*—Sikha Roy

(57) ABSTRACT

A lamp including an arc tube and a holder is provided. The arc tube includes a pair of electrodes respectively at both tube ends, and forms, between the pair of electrodes, a discharge path which turns in a double spiral substantially on one plane. The holder holds the arc tube in a state of fixing the tube ends of the arc tube and at least one part of the arc tube between the tube ends.

20 Claims, 11 Drawing Sheets

300

LAMP HAVING AN ARC TUBE PROTECTED FROM BREAKAGE

This application is based on applications Nos. 2004-203954 and 2005-34894 filed in Japan, the contents of which are hereby incorporated by reference.

BACKGROUND OF THE INVENTION

1. Field of the Invention

The present invention relates to a flat double-spiral lamp.

2. Related Art

FIG. 1 shows a lamp 600 having an arc tube 610 in which a discharge path turns in a double spiral, as one well-known type of compact lamps (German Patent No. 871927). This lamp 600 is a single-based lamp, with both tube ends 611 of the arc tube 610 being held by a holder 630 equipped with a base 620 and a pair of electrodes (not illustrated) sealed at both tube ends 611 being electrically connected to the base 620.

FIG. 2 shows a lamp 700 having an arc tube 710 in which a discharge path turns in a double spiral substantially on one plane (disclosed in Japanese Patent Application Publication No. H09-45283. Note that this type of lamp has not yet been put in practical use). This lamp 700 is thinner than the lamp 600 shown in FIG. 1, because the arc tube 710 is substantially a disc in outside shape whereas the arc tube 610 is substantially a cone in outside shape. Such a lamp 700 allows a lamp fixture to be made thinner, and so is suitable as a light source of a downlight or a wall light recessed in a ceiling or a wall. Also, the lamp 700 is a surface light source having a circular light emitting surface, and so exhibits a favorable light distribution on an irradiated surface. Hence the lamp 700 is suitable for store or home lighting.

As shown in FIG. 2, the lamp 700 is a double-based lamp that is equipped with separate bases 720*a* and 720*b* at both tube ends 711*a* and 711*b* of the arc tube 710. This being so, if an excessive force is applied when inserting the bases 720*a* and 720*b* into sockets of a lamp fixture, the arc tube 710 may be broken near the tube end 711*a* or 711*b*. Besides, to attach the lamp 700 to the lamp fixture, the arc tube 710 needs to be held by hand, which causes a sense of worry about breaking the arc tube 710.

To assume a circular light emitting surface, the arc tube 710 is designed so as to minimize a gap 712 between adjacent turns in a spiraled portion between the tube ends 711*a* and 711*b*. This being the case, when an inner part of the spiraled portion vibrates due to an external impact, adjacent turns in that part may collide with each other, as a result of which the arc tube 710 can be broken. This tends to occur particularly during transportation. With a conventional transportation container that holds only outer edges of the arc tube 710, such vibrations of the inner part of the spiraled portion cannot be prevented.

SUMMARY OF THE INVENTION

In view of the above problems, the present invention aims to provide a flat double-spiral lamp in which an arc tube is protected from breakage during attachment or transportation.

The stated aim can be achieved by a lamp including: an arc tube including a pair of electrodes respectively at both tube ends and for forming, between the pair of electrodes, a discharge path which turns in a double spiral substantially on one plane; and a holder holding the arc tube in a state of fixing the tube ends of the arc tube and at least one part of the arc tube between the tube ends.

According to this construction, even if an excessive force is applied when inserting a base of the lamp into a socket of a lamp fixture, there is no danger of breaking the arc tube near the tube ends, unlike a conventional flat double-spiral lamp having two bases. Also, the holder can be held by hand instead of the arc tube when attaching/detaching the lamp to/from the lamp fixture. Accordingly, the lamp can be used safely as a light source of a lighting unit that is located relatively high, such as a downlight or a wall light. Furthermore, at least one part of the arc tube between the tube ends is fixed by the holder. This prevents an inner part of a spiraled portion of the arc tube from vibrating due to impact during transportation. Therefore, there is no danger that adjacent turns of the arc tube collide with each other and as a result the arc tube is broken. Hence the lamp can be safely transported using a conventional transportation container that holds only outer edges of the arc tube.

Here, the lamp may further include a base provided on the holder so as to be attachable to a lamp fixture.

According to this construction, the lamp can be attached to or detached from the lamp fixture more easily.

Here, the holder may include fitting parts for fixing the tube ends of the arc tube.

According to this construction, the lamp can be assembled easily.

Here, guide grooves for guiding the tube ends of the arc tube into the fitting parts may be formed in the holder.

According to this construction, the tube ends can be easily fitted into the fitting parts, with it being possible to further ease the assembly of the lamp.

Here, the lamp may further include a wire embedded in the holder to electrically connect the pair of electrodes to the base.

According to this construction, a wiring operation can be conducted easily, which eases the assembly of the lamp. Such an assembly can be automated without difficulty. Also, the lamp can be made thinner.

Here, a positioning groove may be formed on a surface of the holder facing the arc tube, along a tube axis of the arc tube, wherein a part of the arc tube is fitted in the positioning groove.

According to this construction, the inner part of the spiraled portion of the arc tube is prevented from vibration more reliably.

Here, at least one part of the arc tube may be bonded to the holder using an adhesive.

According to this construction, the arc tube can be fixed more firmly.

Here, the holder may be a substantially rectangular plate-like member positioned in parallel with the plane, wherein the tube ends of the arc tube are fixed to both ends of the holder in a longitudinal direction, and a tube center of the arc tube is fixed to a center of the holder.

According to this construction, the lamp can be made thinner while maintaining the protection of the arc tube from breakage. Also, the holder has a simple structure, which contributes to higher industrial productivity.

Here, the holder may be a substantially cross-shaped plate-like member positioned in parallel with the plane, wherein the tube ends of the arc tube are fixed to two opposite ends of the holder, and a tube center of the arc tube is fixed to a center of the holder.

According to this construction, the lamp can be made thinner while maintaining the protection of the arc tube from breakage. Also, the holder has a simple structure, which contributes to higher industrial productivity.

Here, the lamp may further include a cover attached to the holder so as to cover at least outer edges of the arc tube.

According to this construction, the outer edges of the arc tube are protected by the cover, thereby making the arc tube more resistant to breakage.

Here, the lamp may further include a cover attached to the holder so as to cover at least outer edges of the arc tube and a holder side of the arc tube, and having an optical reflection plane on a surface facing the arc tube.

According to this construction, a luminous flux can be efficiently extracted from inside the cover. Therefore, even when the lamp is attached to a simple lamp fixture which does not include a reflection plate, a relatively high illuminance can be attained.

The appearance of the lamp can be improved by setting a gap Gb between adjacent turns of the arc tube at each of the tube ends to be equal to a gap Ge between adjacent turns of the arc tube in a predetermined part of a spiraled portion between the tube ends. Ge needs to be set small to downsize the lamp. If Gb is made equal to such a small Ge, there is a possibility that, in an electrode sealing step, an adjacent part to any of the tube ends is affected by heat from a burner or a sealing jig for sealing the electrodes to the tube ends cannot be used for lack of a sufficient space. Therefore, when Ge is relatively small, it is preferable to set Gb such that the adjacent part to the tube end will not be affected by heat from the burner and the sealing jig can be used in the electrode sealing step, while also taking factors such as the lamp appearance and the holder structure into consideration.

In view of this, a gap between adjacent turns of the arc tube may be larger at each of the tube ends than in a predetermined part of a spiraled portion between the tube ends, the gap being substantially uniform in the predetermined part.

According to this construction, a space for fixing the tube ends to the holder can be ensured. Also, the tube ends can be heated sufficiently by the burner in the electrode sealing step, so that a crack in the electrode sealing part and a leakage of mercury or buffer gas from the arc tube due to such a crack can be prevented. Also, the electrodes can be kept from being displaced and contacting the inner wall of the arc tube. This contributes to a higher yield of nondefective units.

Here, the ranges $0.5 \leqq Ge \leqq 2.0$ and $3.0 \leqq Gb \leqq 10.0$ may be set where Ge denotes the gap in the predetermined part in mm and Gb denotes the gap at each of the tube ends in mm.

According to this construction, a nondefective unit yield of 99.5% at the maximum can be achieved.

Here, the gap may increase from Ge in a part of the spiraled portion in which a tube axis extends more closely toward each of the tube ends than in the predetermined part, with a straight line that connects a tube center of the arc tube and a point at which the gap begins to increase being substantially orthogonal to a straight line that connects the tube center and the tube ends.

According to this construction, the appearance of the lamp can be further improved.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT (Embodiment)

The following describes a lamp to which an embodiment of the present invention relates, with reference to drawings.

(Construction of the Lamp)

FIG. 3 shows a lamp 1 according to the embodiment of the present invention. This lamp 1 is a fluorescent lamp used, for example, for a downlight or a wall light directly mounted on a ceiling or a wall of a store, a house, and the like. The lamp 1 is roughly made up of an arc tube 10 and a holder 20 which holds the arc tube 10.

(1) Arc Tube 10

Figure 1A:
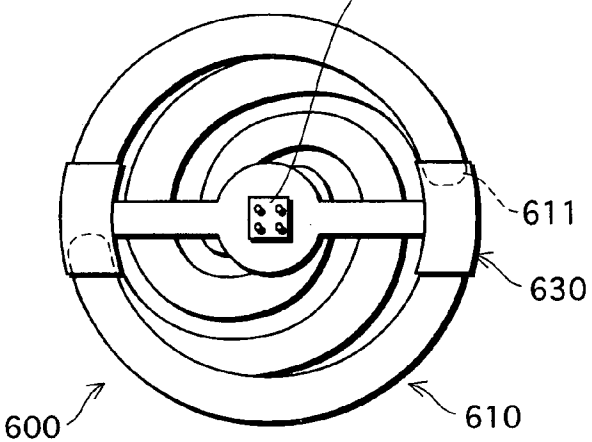
FIG.1A Prior Art
FIG. 1A is a bottom view, FIG. 1B a top view, FIG. 1C a front view, and FIG. 1D a side view.
Figure 1B:
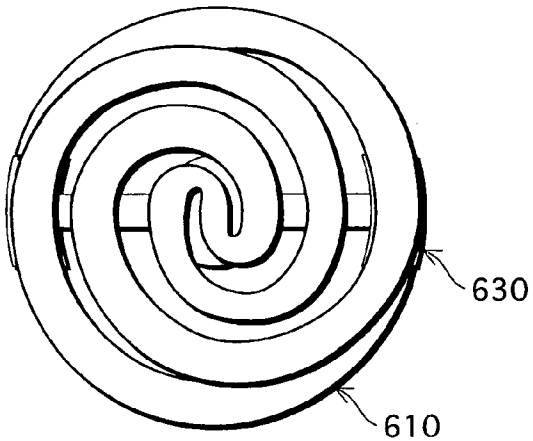
FIG.1B Prior Art
FIG. 1 shows a conventional lamp, where
Figure 1C:
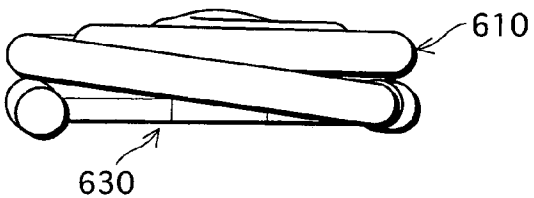
FIG.1C Prior Art
Figure 1D:
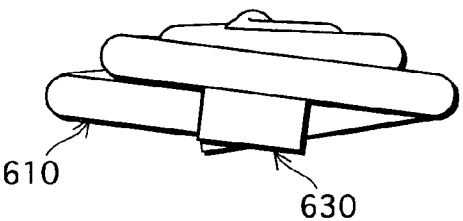
FIG.1D Prior Art
Figure 2A:
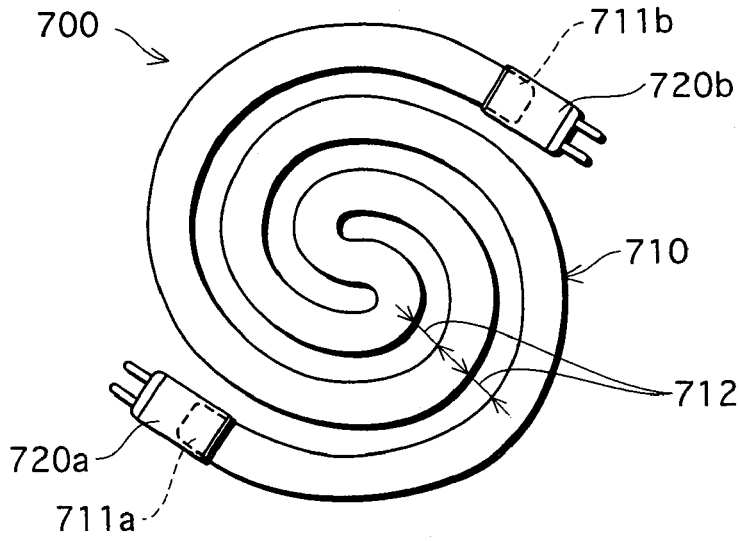
FIG.2A Prior Art
FIG. 2A is a top view, FIG. 2B a front view, and FIG. 2C a side view.
Figure 2B:
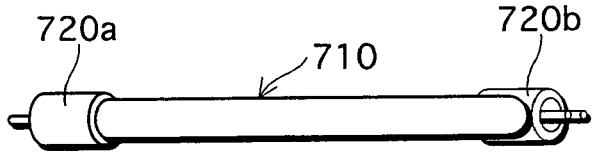
FIG.2B Prior Art
FIG. 2 shows another conventional lamp, where
Figure 2C:
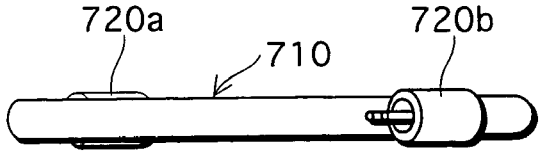
FIG.2C Prior Art
Figure 3B:
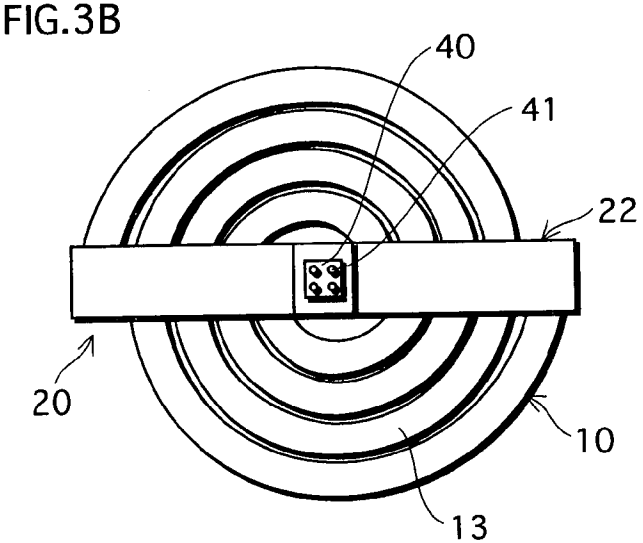
FIG. 3 shows a lamp to which an embodiment of the present invention relates, where
FIG. 3A is a top view, FIG. 3B a bottom view, FIG. 3C a front view, and FIG. 3D a side view.
Figure 3D:
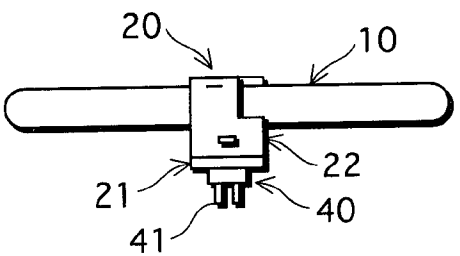
Figure 3A:
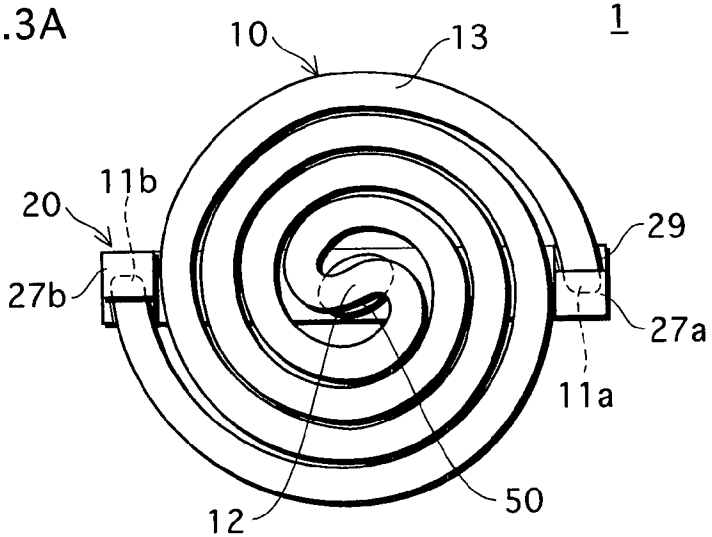
Figure 3C:
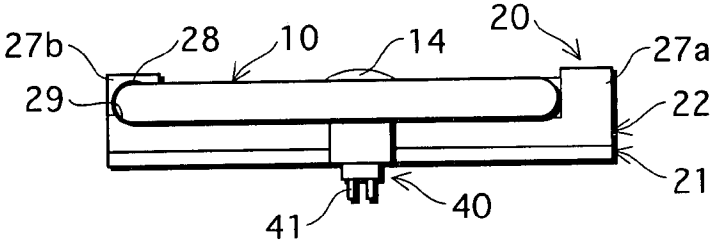
Figure 4A:
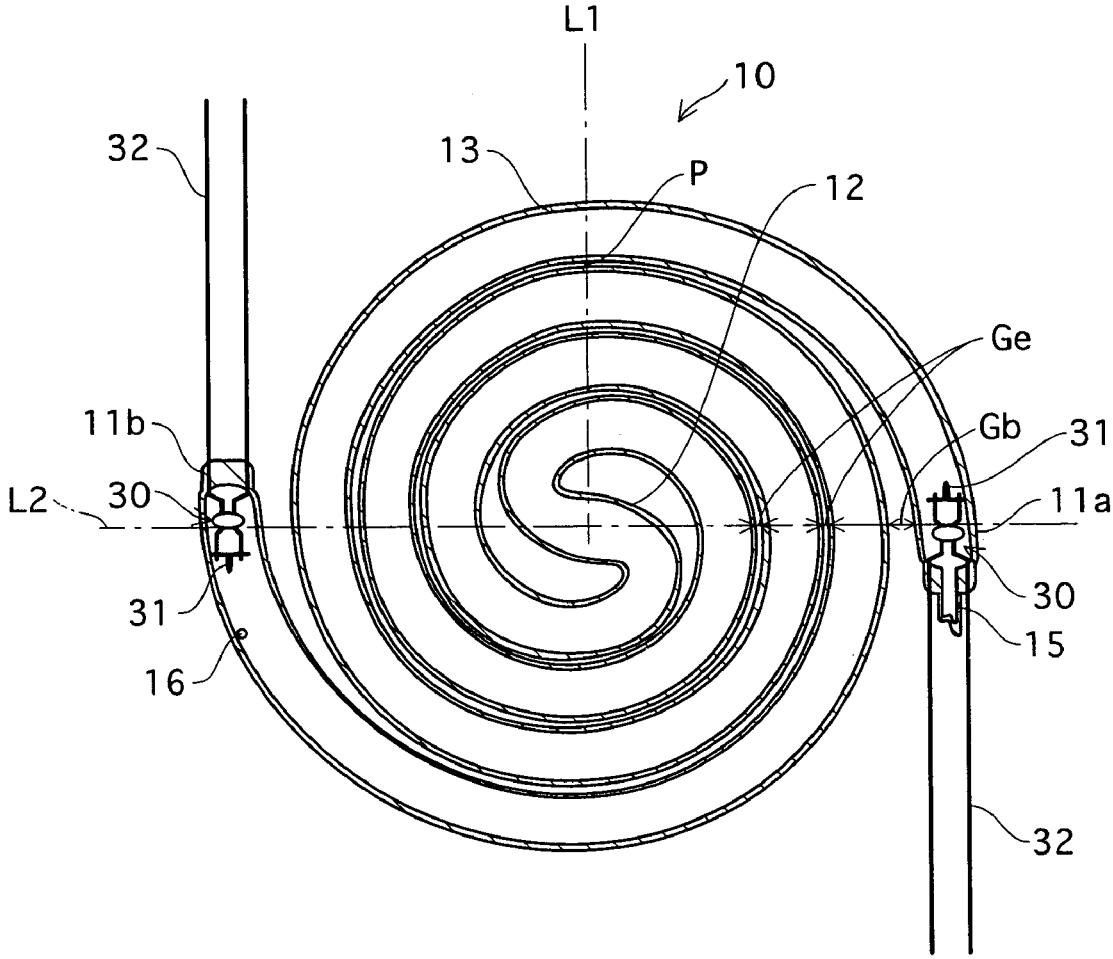
FIG. 4A is a sectional top view and FIG. 4B a front view.
Figure 4B:
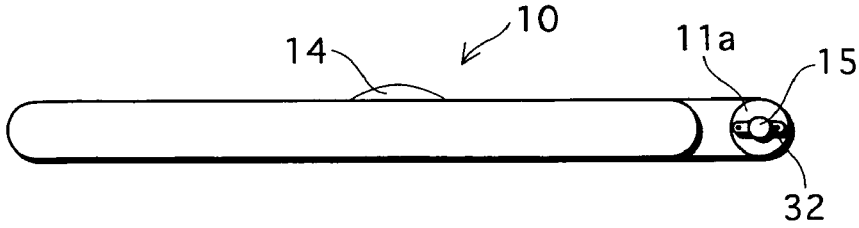
FIG. 4 shows an arc tube in the lamp shown in FIG. 3, where

FIG. 4 shows the arc tube 10 before being attached to the holder 20. As shown in the drawing, the arc tube 10 is shaped as a flat double spiral. This being so, a discharge path which, centered on a midway portion thereof, turns in a double spiral substantially on one plane is formed between one pair of electrodes 30 provided at both tube ends 11*a* and 11*b* of the arc tube 10. The tube ends 11*a* and 11*b* are opposite to each other with a tube center 12, which corresponds to the midway portion of the discharge path, in between.

A gap between adjacent turns of the arc tube 10, i.e. a gap between adjacent turns of a glass tube 13 which constitutes the arc tube 10 together with the pair of electrodes 30, is as follows. The gap between adjacent turns of the glass tube 13 is substantially uniform in a spiraled portion between the tube ends 11*a* and 11*b*, except the tube center 12 and its neighboring part and neighboring parts of the tube ends 11*a* and 11*b*

(this substantially uniform gap is denoted by Ge). The gap between adjacent turns of the glass tube 13 increases as the tube ends 11*a* and 11*b* approach, in the neighboring parts of the tube ends 11*a* and 11*b*. As a result, the gap between adjacent turns of the glass tube 13 at the tube ends 11*a* and 11*b* (this gap is denoted by Gb) is larger than the gap Ge.

A straight line L1 which connects the tube center 12 and a point P at which the gap begins to increase forms an angle of about 90° with a straight line L2 which connects the tube center 12 and the tube ends 11*a* and 11*b*. In other words, the straight line L1 is substantially orthogonal to the straight line L2. In this case, the neighboring parts of the tube ends 11*a* and 11*b* are such parts that extend inwardly from the tube ends 11*a* and 11*b* to points forming an angle of about 45° with the tube ends 11*a* and 11*b*. By heating the glass tube 13 at and near the point P to soften and processing the glass tube 13 so as to widen the gap between adjacent turns from the point P, the arc tube 10 with the tube ends 11*a* and 11*b* spreading out can be obtained without compromising appearance.

For example, in the case of a 27 W lamp, the glass tube 13 has an outside diameter of 9.0 mm, an inside diameter of 8.0 mm, and a total length of 850 mm. Also, a distance between the electrodes 30 is 820 mm, and a diameter of a substantial circle defined by the arc tube 10 is 130 mm. Further, the gap Ge is 1.0 mm, the gap Gb is 5.0 mm, and a number of turns of the glass tube 13 is 4.1. The glass tube 13 is made of barium-strontium silicate glass (soft glass with a softening point of 675° C.) as one example.

To make the lamp 1 compact, it is preferable to limit the inside diameter of the glass tube 13 in a range of 3.0 mm to 20.0 mm, and a tube input in a range of 6 W to 80 W.

When the gap Ge is small, a large gap Gb is preferable to maintain a high yield of nondefective units in a step of sealing the electrodes 30 at the tube ends 11*a* and 11*b*. In detail, when the gap Ge is in a range of 0.5 mm to 2.0 mm, the gap Gb is preferably in a range of 3.0 mm to 10.0 mm.

If the gap Gb is no smaller than 3.0 mm, it is possible to sufficiently heat the tube ends 11*a* and 11*b* using a burner in the electrode sealing step. This suppresses defects such as the sealed portions being cracked and as a result leaking or the electrode coils touching the inner walls of the tube ends 11*a* and 11*b*, so that a higher yield of nondefective units can be achieved.

A gap Gb exceeding 10 mm is basically undesirable, since processability decreases and also the appearance of the lamp 1 is ruined thereby causing a decrease in commercial value. Depending on the shape and size of the lamp 1, however, these problems may not arise even if the gap Gb is over 10 mm.

An opposite surface of the tube center 12 to the holder 20 slightly protrudes in an expanded condition, thereby forming a bulge 14. This bulge 14 is a coldest spot of the lamp 1 at the time of lighting. For example, if the inside diameter of the glass tube 13 is in a range of 3 mm to 16 mm, a favorable luminous efficiency can be achieved by designing the lamp 1 so that the temperature of the bulge 14 is in a range of 40° C. to 50° C. during lighting.

Each of the electrodes 30 includes a filament coil 31 made of tungsten and one pair of lead wires 32. The electrode 30 is hermetically sealed in a corresponding one of the tube ends 11*a* and 11*b* at the pair of lead wires 32 according to a glass bead mounting method, in a state where the filament coil 31 is contained inside the arc tube 10. Also, an exhaust pipe 15 is hermetically sealed in the tube end 11*a*, in a state where a tip of the exhaust pipe 15 is sealed inside the arc tube 10. The exhaust pipe 15 is used for introducing a rare gas into the arc tube 10.

The electrode sealing step is explained in detail below, taking an example of the tube end 11*a*. The tube end 11*a* in which the pair of lead wires 32 and the exhaust pipe 15 are inserted is heated to soften by a burner from opposite sides of the plane on which the discharge path of the arc tube 10 lies. The softened portion is then crushed from the opposite sides using a pinch block which serves as a sealing jig, thereby sealing the tube end 11*a*. The resulting sealed portion has a surface that coincides with the plane on which the discharge path of the arc tube 10 lies. In this way, the tube ends 11*a* and 11*b* can be easily sealed without being obstructed by adjacent parts of the spiraled portion to the tube ends 11*a* and 11*b*, which contributes to a higher yield of nondefective units.

A phosphor layer (not illustrated) of a rare-earth phosphor composed of a red phosphor ($Y_2O_3$:Eu), a green phosphor ($LaPO_4$:Ce, Tb), and a blue phosphor ($BaMg_2Al_{16}O_{27}$:Eu, Mn) is formed on the inner wall of the arc tube 10. Note here that the phosphor layer may be composed of phosphors other than the above. Also, the present invention includes not only a lamp which has a phosphor layer but also a lamp which does not have a phosphor layer.

Five milligrams of mercury 16 is enclosed in the arc tube 10. In addition, a gas mixture of argon and neon (Ar+25% Ne) is enclosed in the arc tube 10 as a buffer gas, at a pressure of about 400 Pa. The mercury 16 enclosed may be a simple substance or a mercury amalgam with zinc, tin, or bismuth-indium. The gas enclosed may be a gas mixture of argon, neon, krypton, and the like.

(2) Holder 20

Figure 5A:
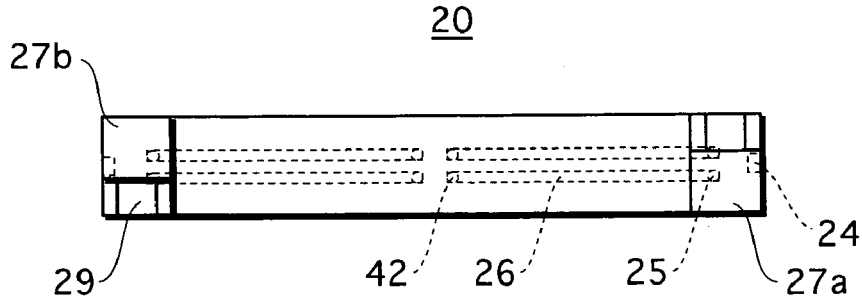
FIG. 5A is a top view, FIG. 5B a front view, and FIG. 5C a side view.
Figure 5B:
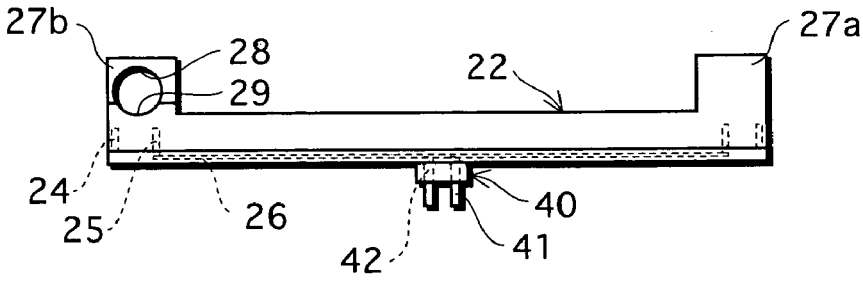
FIG. 5 shows a holder in the lamp shown in FIG. 3, where
Figure 5C:
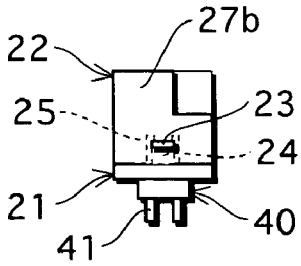
Figure 6A:
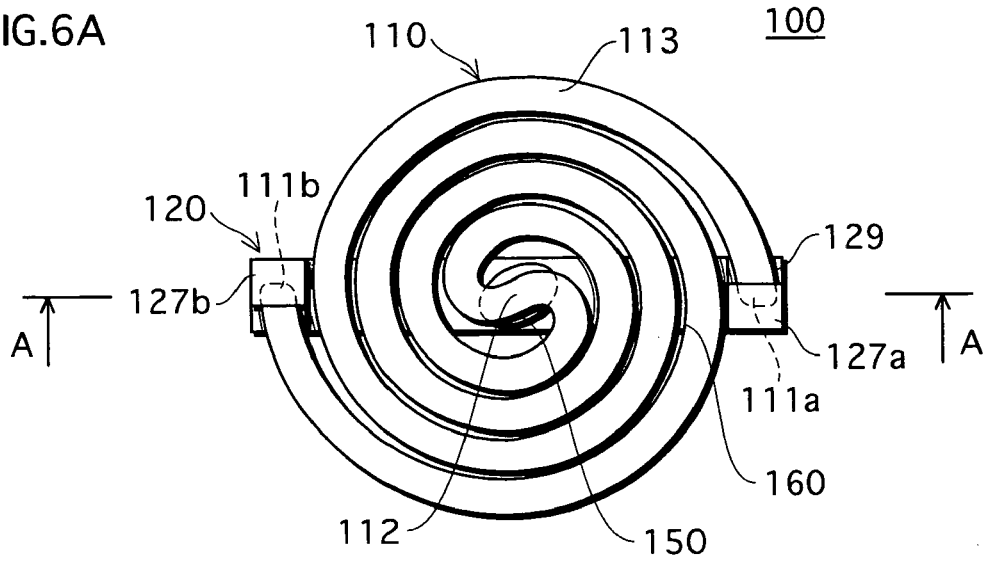
FIG. 6A is a top view, FIG. 6B a sectional view taken along line A-A given in FIG. 6A, FIG. 6C a front view, and FIG. 6D a side view.
Figure 6B:
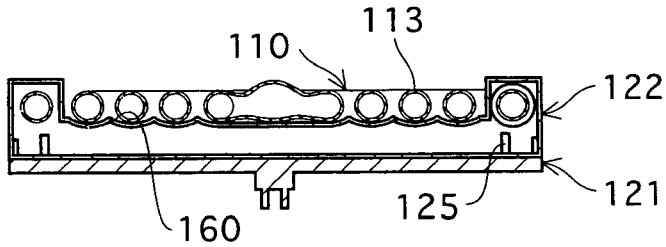
FIG. 6 shows a lamp to which a first modification of the present invention relates, where
Figure 6C:
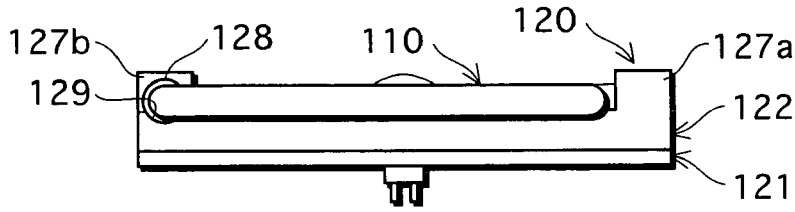
Figure 6D:
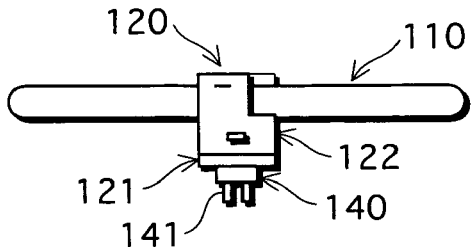

FIG. 5 shows the holder 20. In the drawing, the holder 20 is a long rectangular platelike member made of a resin. The holder 20 includes a holder body 21 which supplies power to the arc tube 10, and a fixing member 22 which fixes the tube ends 11*a* and 11*b* of the arc tube 10.

The holder body 21 and the fixing member 22 are formed in one piece, by fitting tips of stoppers 24 formed at both ends of the holder body 21 into holes 23 formed at both ends of the fixing member 22.

Two pairs of electrode terminals 25 for connecting to the lead wires 32 of the arc tube 10 are partially embedded respectively at both ends of a surface of the holder body 21 facing the arc tube 10.

Also, a base 40 having four power connecting terminals 41 is provided at a center on an opposite surface of the holder body 21 to the arc tube 10. The four power connecting terminals 41 are connected with pin-type connecting terminals 42, which are connected with the electrode terminals 25 via wires 26 embedded in the holder body 21. In this way, the electrodes 30 of the arc tube 10 and the base 40 are electrically connected to each other.

Meanwhile, fitting parts 27*a* and 27*b* used for fixing the arc tube 10 are formed at both ends on a surface of the fixing member 22 facing the arc tube 10. Each of the fitting parts 27*a* and 27*b* has a circular hole 28 that conforms to the outside diameter of the arc tube 10. Also, a guide groove 29 which is substantially semicircular in cross section is formed on a tube end entering side of the fitting part in front of the hole 28, to guide a corresponding one of the tube ends 11*a* and 11*b* into the hole 28.

(Method of Assembling the Lamp 1)

The lamp 1 having the above construction is assembled in the following manner. Having applied an adhesive 50 to a substantially middle portion on the surface of the fixing member 22 facing the arc tube 10, the tube ends 11*a* and 11*b* of the arc tube 10 are fitted into the holes 28 of the fixing member 22. Following this, in a state where the fixing member 22 is positioned substantially in parallel with the plane on which the discharge path of the arc tube 10 lies, the tube center 12 of the arc tube 10 is pressed against the adhesive 50 so that the arc tube 10 is secured to the fixing member 22. Furthermore, an adhesive (not illustrated) is poured into gaps between the inner walls of the holes 28 and the tube ends 11*a* and 11*b* so that the tube ends 11*a* and 11*b* are secured to the fitting parts 27*a* and 27*b*. Lastly, after connecting the lead wires 32 of the arc tube 10 to the electrode terminals 25 of the holder body 21, the holder body 21 and the fixing member 22 are integrated to complete the lamp 1.

The adhesive used here may be silicone resin, epoxy resin, acrylic resin, or cement.

(Evaluations of the Lamp 1)

The assembly operation of the lamp 1 of this embodiment was evaluated. As a result, the lamp 1 showed a same level of processability as a conventional single-based compact lamp. This indicates the assembly operation of the lamp 1 can be automated without difficulty.

Also, the ease of attachment/removal of the lamp 1 of this embodiment was evaluated. As a result, the lamp 1 was able to be attached and removed more easily than a conventional double-based lamp. In addition, since the arc tube 10 is fixed by the holder 20, the lamp 1 can be handled without worrying about breaking the arc tube 10. The arc tube 10 was actually unbroken when the lamp 1 was attached to and removed from a lamp fixture.

Also, the endurance of the lamp 1 of this embodiment during transportation was evaluated. As a result, the lamp 1 showed a low breakage ratio even when a transportation container such as the one for conventional compact lamps was used.

Furthermore, various properties of the lamp 1 of this embodiment were evaluated through experiment. In detail, the lamp 1 was lit using an electronic ballast dedicated for high frequencies, and various properties of the lamp 1 were measured. Here, the tube input of the lamp 1 was 27 W. As a result, the lamp 1 showed excellent lamp properties with a luminous flux of 2210 lm and a luminous efficiency of 81.9 lm/W. Also, a rating life of the lamp 1 was about 10000 hours on average.

Equally excellent lamp properties were observed when the same experiment was conducted on lamps other than the 27 W tube input type, over a wide range of tube inputs from 6 W to 80 W (3.0 mm to 16.0 mm in inside diameter).

(Modifications)

The present invention has been described by way of the above embodiment, though it should be obvious that the present invention is not limited to the above. Example modifications are given below.

(1) First Modification

FIG. 6 shows a lamp 100 to which a first modification of the present invention relates. As shown in the drawing, the lamp 100 is roughly made up of an arc tube 110 and a holder 120.

The arc tube 110 is of the same type as the arc tube 10 in the lamp 1 of the above embodiment. In detail, the arc tube 110 is shaped as a flat double spiral. This being so, a discharge path which, centered on a midway portion thereof, turns in a double spiral substantially on one plane is formed between one pair of electrodes (not illustrated) provided at both tube ends 111*a* and 111*b* of the arc tube 110. The tube ends 111*a* and 111*b* are opposite to each other with a tube center 112, which corresponds to the midway portion of the discharge path, in between.

The holder 120 is a long rectangular platelike member made of a resin, and includes a holder body 121 and a fixing member 122.

The holder body 121 is of the same type as the holder body 21 in the lamp 1 of the above embodiment. In detail, electrode terminals 125 are partially embedded at both ends of a surface of the holder body 121 facing the arc tube 110, and a base 140 having power connecting terminals 141 which are connected to the electrode terminals 125 via wires (not illustrated) is provided at a center on an opposite surface of the holder body 121 to the arc tube 110.

Fitting parts 127*a* and 127*b* for fixing the arc tube 110 are formed at both ends on a surface of the fixing member 122 facing the arc tube 110. Each of the fitting parts 127*a* and 127*b* has a hole 128. Also, a guide groove 129 for guiding a corresponding one of the tube ends 111*a* and 111*b* into the hole 128 is formed on a tube end entering side of the fitting part in front of the hole 128.

Furthermore, positioning grooves 160 are formed on the surface of the fixing member 122 facing the arc tube 110, along a tube axis of the arc tube 110. The positioning grooves 160 are shaped substantially semicircular in cross section in accordance with an outside diameter of a glass tube 113 which constitutes the arc tube 110 together with the pair of electrodes. The arc tube 110 is positioned such that the holder 120 side of the glass tube 113 is fitted in these positioning grooves 160, and then fixed to the fixing member 122. This keeps adjacent turns of the glass tube 113 from approaching each other. Accordingly, an inner part of a spiraled portion of the glass tube 113 is prevented from vibration, with it being possible to protect the arc tube 110 from breakage.

The arc tube 110 is fixed to the fixing member 122 at the tube center 112 and the tube ends 111*a* and 111*b*, using an adhesive 150. An adhesive may also be poured into gaps between the arc tube 110 and walls of the positioning grooves 160, to fix the arc tube 110 to the fixing member 122 more firmly.

(2) Second Modification

Figure 7A:
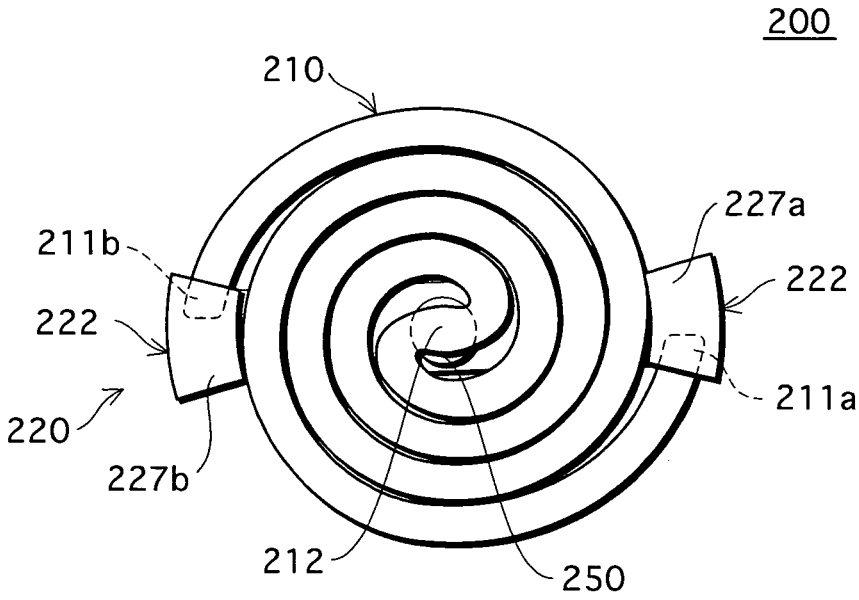
FIG. 7A is a top view, FIG. 7B a front view, and FIG. 7C a side view.
Figure 7B:
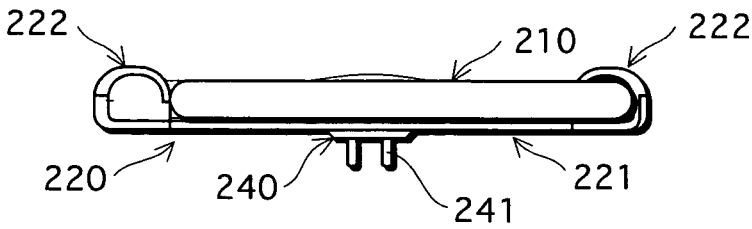
FIG. 7 shows a lamp to which a second modification of the present invention relates, where
Figure 7C:
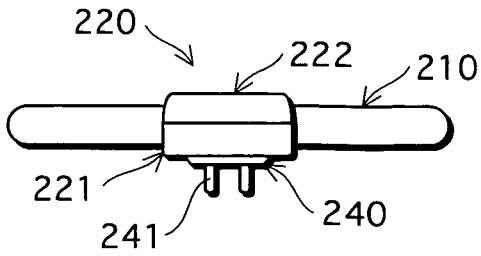
Figure 8A:
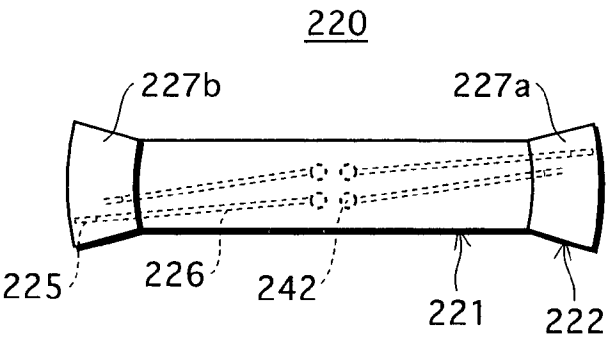
FIG. 8A is a top view, FIG. 8B a side view, FIG. 8C an exploded front view, and FIG. 8D an exploded side view.
Figure 8B:
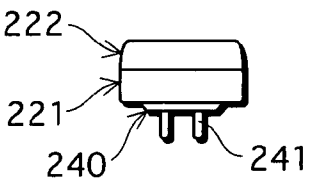
FIG. 8 shows a holder in the lamp shown in FIG. 7, where
Figure 8C:
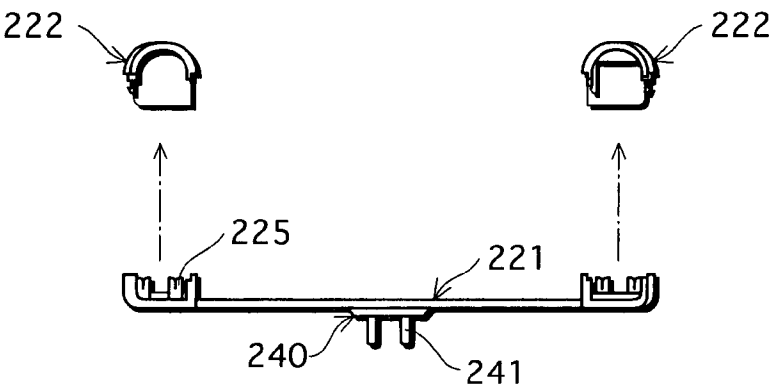
Figure 8D:
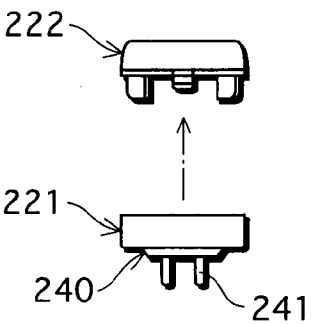
Figure 9B:
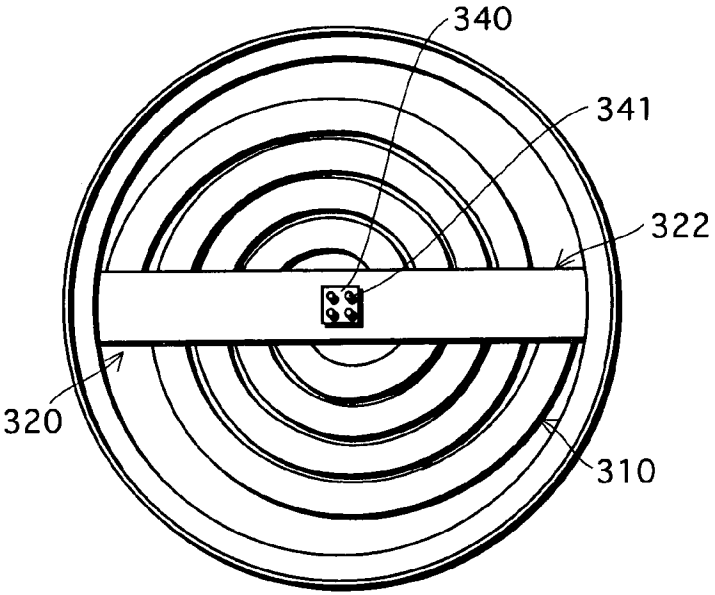
FIG. 9 shows a lamp to which a third modification of the present invention relates, where
FIG. 9A is a top view, FIG. 9B a bottom view, FIG. 9C a front view, and FIG. 9D a side view.
Figure 9D:
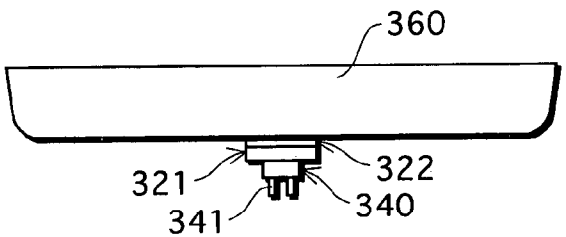
Figure 9A:
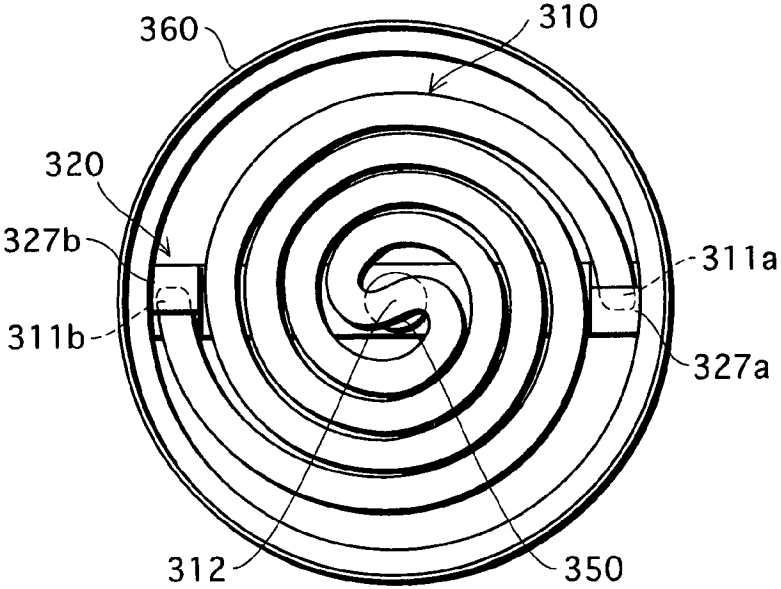
Figure 9C:
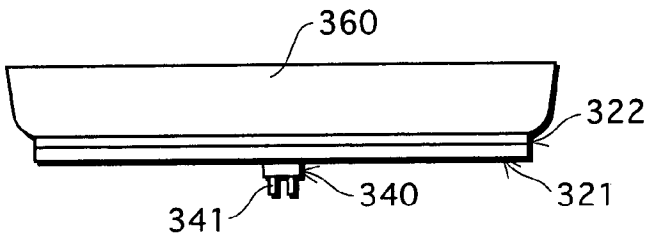
Figure 10A:
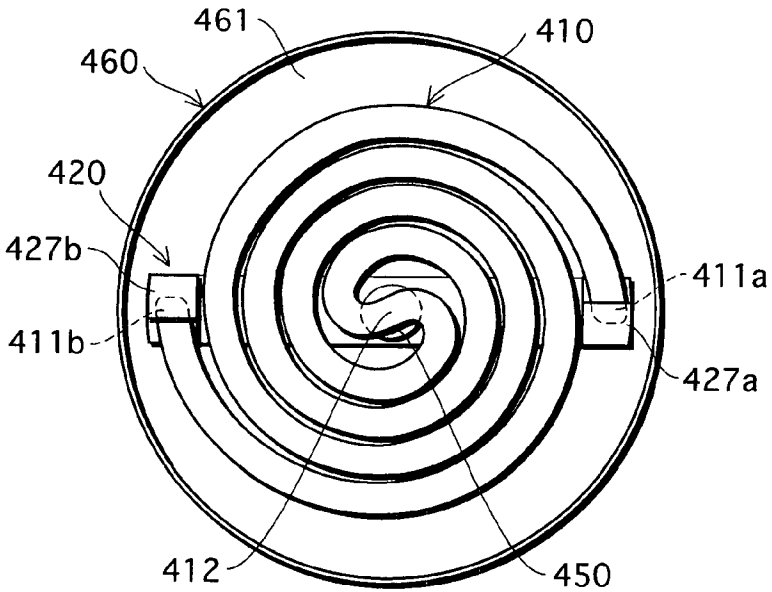
FIG. 10A is a top view, FIG. 10B a bottom view, FIG. 10C a front view, and FIG. 10D a side view.
Figure 10B:
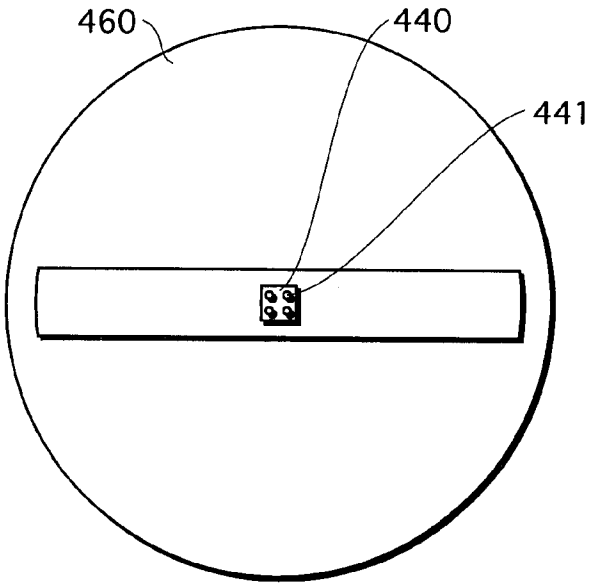
FIG. 10 shows a lamp to which a fourth modification of the present invention relates, where
Figure 10C:
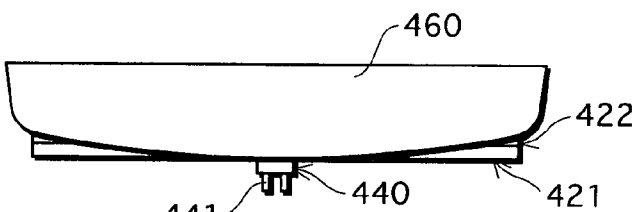
Figure 10D:
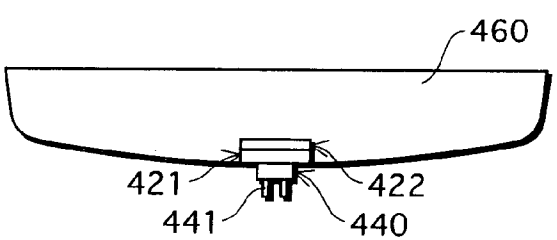

FIG. 7 shows a lamp 200 to which a second modification of the present invention relates. In the drawing, the lamp 200 is roughly made up of an arc tube 210 and a holder 220. FIG. 8 shows the holder 220.

The arc tube 210 is of the same type as the arc tube 10 in the lamp 1 of the above embodiment. In detail, the arc tube 210 is shaped as a flat double spiral. This being so, a discharge path which, centered on a midway portion thereof, turns in a double spiral substantially on one plane is formed between one pair of electrodes (not illustrated) provided at both ends 211*a* and 211*b* of the arc tube 210. The tube ends 211*a* and 211*b* are opposite to each other with a tube center 212, which corresponds to the midway portion of the discharge path, in between.

The holder 220 includes a holder body 221 which is a long rectangular platelike member made of a resin with slightly wider ends, and one pair of end covers 222 attached to both ends of the holder body 221. Electrode terminals 225 are partially embedded at both ends of a surface of the holder body 221 facing the arc tube 210. Also, a base 240 having power connecting terminals 241 is provided at a center on an opposite surface of the holder body 221 to the arc tube 210. These power connecting terminals 241 are connected with pin-type connecting terminals 242, which are connected with the electrode terminals 225 via wires 226.

The end covers 222 are used for holding and fixing the tube ends 211*a* and 211*b* of the arc tube 210. The end covers 222 form fitting parts 227*a* and 227*b* together with both ends of the holder body 221. In a state where the tube ends 211*a* and 211*b* of the arc tube 210 are positioned at both ends of the holder body 221, the end covers 222 are attached to the holder body 221 so as to cover the tube ends 211*a* and 211*b*.

The tube center 212 of the arc tube 210 is fixed to the holder 220 using an adhesive 250. Also, the tube ends 211*a* and 211*b* of the arc tube 210 are fixed to the fitting parts 227*a* and 227*b* of the holder 220 using an adhesive (not illustrated).

According to this modification, the fitting parts 227*a* and 227*b* are formed by the end covers 222 and the ends of the holder body 221. This makes it unnecessary to provide a fixing member such as the fixing member 22 in the lamp 1 of the above embodiment. Hence the lamp 200 can be made slimmer.

(3) Third Modification

FIG. 9 shows a lamp 300 to which a third modification of the present invention relates. In the drawing, the lamp 300 is roughly made up of an arc tube 310, a holder 320, and a cover 360.

The arc tube 310 is of the same type as the arc tube 10 in the lamp 1 of the above embodiment. In detail, the arc tube 310 is shaped as a flat double spiral. This being so, a discharge path which, centered on a midway portion thereof, turns in a double spiral substantially on one plane is formed between one pair of electrodes (not illustrated) provided at both ends 311*a* and 311*b* of the arc tube 310. The tube ends 311*a* and 311*b* are opposite to each other with a tube center 312, which corresponds to the midway portion of the discharge path, in between.

The holder 320 includes a holder body 321 and a fixing member 322. The holder body 321 and the fixing member 322 are respectively of the same types as the holder body 21 and the fixing member 22 in the lamp 1 of the above embodiment. In detail, a base 340 having power connecting terminals 341 is provided at a center on an opposite surface of the holder body 321 to the arc tube 310, and fitting parts 327*a* and 327*b* for fixing the arc tube 310 are formed at both ends on a surface of the fixing member 322 facing the arc tube 310.

The tube center 312 of the arc tube 310 is fixed to the holder 320 using an adhesive 350. Also, the tube ends 311*a* and 311*b* of the arc tube 310 are fixed to the fitting parts 327*a* and 327*b* of the holder 320 using an adhesive (not illustrated).

The cover 360 is a short tubular member, and is attached to the holder 320 so as to cover outer edges of the arc tube 310. In detail, the cover 360 is attached to the fixing member 322 so as to contain the arc tube 310 and part of the fixing member 322.

According to this modification, the outer edges of the arc tube 310 are protected by the cover 360, thereby making the arc tube 310 more resistant to breakage.

(4) Fourth Modification

FIG. 10 shows a lamp 400 to which a fourth modification of the present invention relates. In the drawing, the lamp 400 is roughly made up of an arc tube 410, a holder 420, and a cover 460.

The arc tube 410 is of the same type as the arc tube 10 in the lamp 1 of the above embodiment. In detail, the arc tube 410 is shaped as a flat double spiral. This being so, a discharge path which, centered on a midway portion thereof, turns in a double spiral substantially on one plane is formed between one pair of electrodes (not illustrated) provided at both tube ends 411*a* and 411*b* of the arc tube 410. The tube ends 411*a* and 411*b* are opposite to each other with a tube center 412, which corresponds to the midway portion of the discharge path, in between.

The holder 420 includes a holder body 421 and a fixing member 422. The holder body 421 and the fixing member 422 are respectively of the same types as the holder body 21 and the fixing member 22 in the lamp 1 of the above embodiment. In detail, a base 440 having power connecting terminals 441 is provided at a center on an opposite surface of the holder body 421 to the arc tube 410, and fitting parts 427*a* and 427*b* for fixing the arc tube 410 are formed at both ends on a surface of the fixing member 422 facing the arc tube 410.

The tube center 412 of the arc tube 410 is fixed to the holder 420 using an adhesive 450. Also, the tube ends 411*a* and 411*b* of the arc tube 410 are fixed to the fitting parts 427*a* and 427*b* of the holder 420 using an adhesive (not illustrated).

The cover 460 is an umbrella-like member that is attached to the holder 420 so as to cover both the outer edges of the arc tube 410 and the holder 420 side of the arc tube 410. In detail, the cover 460 is attached to the holder 420 so as to cover the arc tube 410 and the fixing member 422 from the holder body 421 side. An optical reflecting plane 461 is formed on a surface of the cover 460 facing the arc tube 410.

According to this modification, the outer edges and the holder 420 side of the arc tube 410 are protected by the cover 460, which makes the arc tube 410 more resistant to breakage. Also, even when attached to a simple lamp fixture which does not include a reflecting plate, the lamp 400 exhibits a relatively high illuminance.

It should be noted here that the shape of the cover 460 is not limited to an umbrella. For example, by shaping the cover 460 like a closed-bottom tube having only one end opened, the lamp 400 can be used as a spotlight. Even when the cover 460 is shaped like such a closed-bottom tube, a luminous flux can be efficiently extracted from inside the cover 460, since the optical reflecting plane 461 is formed inside the cover 460.

(5) Fifth Modification

FIG. 11 shows a lamp 500 to which a fifth modification of the present invention relates. In the drawing, the lamp 500 is roughly made up of an arc tube 510 and a holder 520.

The arc tube 510 is of the same type as the arc tube 10 in the lamp 1 of the above embodiment. In detail, the arc tube 510 is shaped as a flat double spiral. This being so, a discharge path which, centered on a midway portion thereof, turns in a double spiral substantially on one plane is formed between one pair of electrodes (not illustrated) provided at both ends 511*a* and 511*b* of the arc tube 510. The tube ends 511*a* and 511*b* are opposite to each other with a tube center 512, which corresponds to the midway portion of the discharge path, in between.

The holder 520 is a cross-shaped platelike member made of a resin. The holder 520 includes a long rectangular holder body 521 and a cross-shaped fixing member 522. The holder body 521 is of the same type as the holder body 21 in the lamp 1 of the above embodiment. In detail, a base 540 having power connecting terminals 541 is attached to the holder body 521.

Figure 11B:
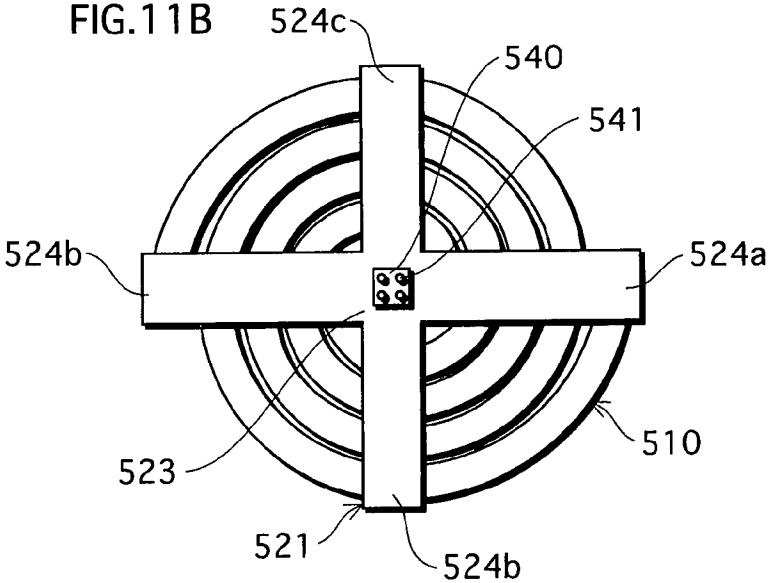
FIG. 11 shows a lamp to which a fifth modification of the present invention relates, where
FIG. 11A is a top view, FIG. 11B a bottom view, FIG. 11C a front view, and FIG. 11D a side view.
Figure 11D:
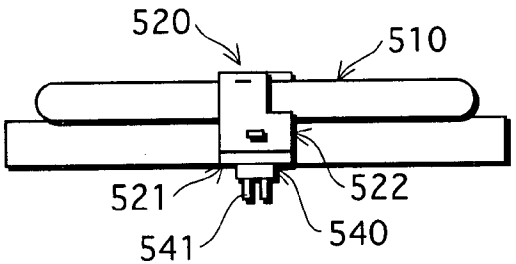
Figure 11A:
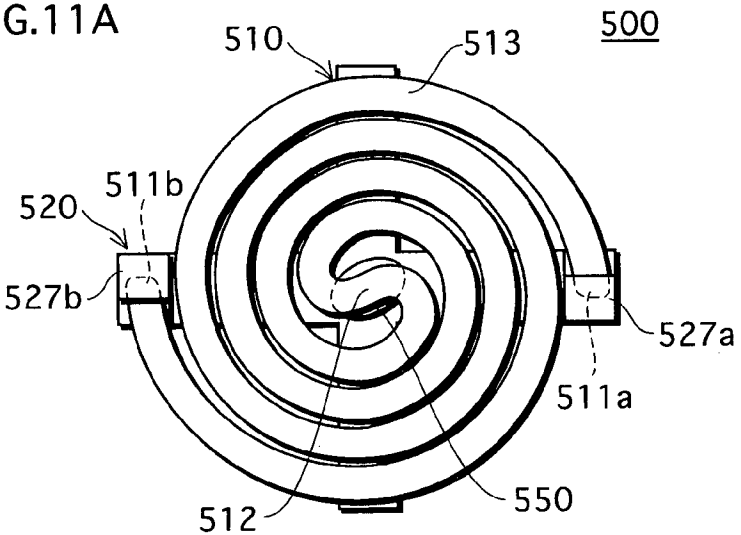
Figure 11C:
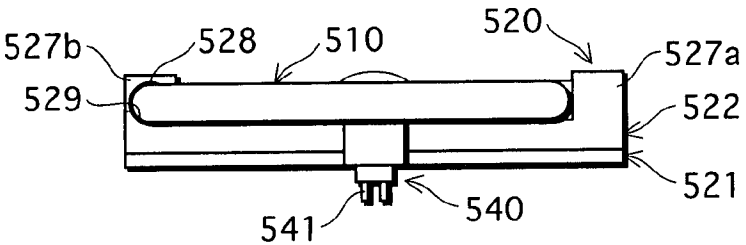

Fitting parts 527*a* and 527*b* for fixing the tube ends 511*a* and 511*b* of the arc tube 510 are formed at two ends 524*a* and 524*b* of the fixing member 522 that oppose to each other with a cross center 523 in between as shown in FIG. 11B. On the other hand, no fitting parts are formed at remaining two ends 524*c* and 524*d* which oppose to each other with the cross center 523 in between. The fitting parts 527*a* and 527*b* each have a hole 528. Also, a guide groove 529 for guiding a corresponding one of the tube ends 511*a* and 511*b* into the hole 528 is formed on a tube end entering side of the fitting part in front of the hole 528.

The tube center 512 of the arc tube 510 is fixed to the holder 520 using an adhesive 550. Also, the tube ends 511*a* and 511*b* of the arc tube 510 are fixed to the fitting parts 527*a* and 527*b* of the holder 520 using an adhesive (not illustrated). Furthermore, the arc tube 510 is fixed to the ends 524*c* and 524*d* of the fixing member 522 at which no fitting parts are provided, using an adhesive (not illustrated).

According to this modification, the four ends 524*a* to 524*d* of the fixing member 522 extend outward over the outer edges of the arc tube 510. Accordingly, the outer edges of the arc tube 510 are protected by the ends 524*a* to 524*d* on four sides. This makes the arc tube 510 more resistant to breakage.

Also, the arc tube 510 is fixed to the holder 520 at a total of five locations, namely, the tube center 512, the tube ends 511*a* and 511*b*, and the portions corresponding to the ends 524*c* and 524*d* of the fixing member 522 where no fitting parts are provided. This suppresses vibrations of an inner part of a spiraled portion of the arc tube 510, with it being possible to protect the arc tube 510 from breakage during transportation and the like.

The present invention is applicable to a fluorescent lamp having a flat double-spiral arc tube in which a discharge path, centered on a midway portion thereof, turns in a double spiral substantially on one plane.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A lamp comprising:

an arc tube including a pair of electrodes respectively at both tube ends defining, between the pair of electrodes, a discharge path which turns in a double spiral substantially on one plane having a gap, Ge, on said plane between adjacent turns in a spiraled portion of the arc tube; and a holder for holding only both tube ends and a tube center of the arc tube, in a state where (i) ends of the holder are bonded to (i) the tube ends of the arc tube and (ii) a center part of the holder is bonded to the tube center of the arc tube, using an adhesive.

2. The lamp of claim 1 further comprising a base provided on the holder so as to be attachable to a lamp fixture.

3. The lamp of claim 2 further comprising a wire embedded in the holder to electrically connect the pair of electrodes to the base.

4. The lamp of claim 1, wherein the holder includes fitting parts for fixing the tube ends of the arc tube.

5. The lamp of claim 4, wherein guide grooves for guiding the tube ends of the arc tube into the fitting parts are formed in the holder.

6. The lamp of claim 4, wherein a gap Gb between adjacent turns of the arc tube is larger at each of the tube ends than in a predetermined part of a spiraled portion between the tube ends, the gap being substantially uniform in the predetermined part.

7. The lamp of claim 1, wherein a positioning groove is formed on a surface of the holder facing the arc tube, along a tube axis of the arc tube, and a part of the arc tube is fitted in the positioning groove.

8. The lamp of claim 7, wherein a gap Gb between adjacent turns of the arc tube is larger at each of the tube ends than in a predetermined part of a spiraled portion between the tube ends, the gap being substantially uniform in the predetermined part.

9. The lamp of claim 1, wherein the holder is a substantially rectangular platelike member positioned in parallel with the plane, and the tube ends of the arc tube are fixed to both ends of the holder in a longitudinal direction, and a tube center of the arc tube is fixed to a center of the holder.

10. The lamp of claim 1, wherein the holder is a substantially cross-shaped platelike member positioned in parallel with the plane, and the tube ends of the arc tube are fixed to two opposite ends of the holder, and a tube center of the arc tube is fixed to a center of the holder.

11. The lamp of claim 1 further comprising a cover attached to the holder so as to cover at least outer edges of the arc tube.

12. The lamp of claim 1 further comprising a cover attached to the holder so as to cover at least outer edges of the arc tube and a holder side of the arc tube, and having an optical reflection plane on a surface facing the arc tube.

13. The lamp of claim 1, wherein the gap Ge between adjacent turns of the arc tube is larger at each of the tube ends than in a predetermined part of a spiraled portion between the tube ends, the gap being substantially uniform in the predetermined part.

14. The lamp of claim 13, wherein $0.5 \leqq Ge \leqq 2.0$, and $3.0 \leqq Gb \leqq 10.0$, where Ge denotes the gap in the predetermined part in mm, and Gb denotes the gap at each of the tube ends in mm.

15. The lamp of claim 13, wherein the gap Gb increases from the gap Ge in a part of the spiraled portion in which a tube axis extends more closely toward each of the tube ends than in the predetermined part, with a straight line that connects a tube center of the arc tube and a point at which the gap begins to increase being substantially orthogonal to a straight line that connects the tube center and the tube ends.

16. A lamp comprising:

an arc tube including a pair of electrodes respectively at both tube ends and defining, between the pair of electrodes, a discharge path which turns in a double spiral substantially in one plane having a gap Gb in the same plane between adjacent turns in a spiraled portion of the arc tube; and a holder for holding only the tube ends of the arc tube and a tube center of the arc tube, in a state where ends of the holder are bonded to (i) the tube ends of the arc tube and (ii) a center part of a holder is bonded to the tube center of the spiraled portion of the arc tube using an adhesive including positioning grooves formed on a surface of the holder, the positioning grooves configured to receive the arc tube and keep the adjacent turns from approaching each other so as to maintain the gap Ge between adjacent turns, the holder positioned substantially parallel to the plane on which the discharge path of the arc tube lies and secured to a tube center of the arc tube.

17. The lamp of claim 16, wherein a gap Gb increases from the gap Ge in a part of the spiraled portion in which a tube axis extends more closely toward each of the tube ends than in the predetermined part, with a straight line that connects a tube center of the arc tube and a point at which the gap Gb begins to increase being substantially orthogonal to a straight line that connects the tube center and the tube ends.

18. The lamp of claim 16, further comprising:

a base provided on the holder so as to be attachable to a lamp fixture and fitting parts for fixing the tube ends of the arc tube.

19. The lamp of claim 16, wherein the gap Gb between adjacent turns of the arc tube is larger at each of the tube ends than in a predetermined part of a spiraled portion between the tube ends, the gap being substantially uniform in the predetermined part.

20. A lamp comprising:

an arc tube including a tube center and electrodes at both tube ends defining, between the pair of electrodes, a discharge path which turns in a double spiral substantially in one plane having a gap on said plane between adjacent turns in a spiraled portion of the arc tube; and a holder for holding only the tube ends of the arc tube and a tube center of the arc tube, in a state where (i) ends of the holder are adhesively bonded to the ends of the arc tube, and (ii) a center part of the holder is adhesively bonded to the tube center of the arc tube using an adhesive member positioned substantially parallel with the plane on which the discharge path lies for securing the arc tube to the holder at the tube ends and the tube center to reduce the relative movement between adjacent turns and prevent contact therebetween.

* * * * *